United States Patent [19]

Plohberger et al.

[11] Patent Number: 5,040,496

[45] Date of Patent: Aug. 20, 1991

[54] TWO-STROKE INTERNAL COMBUSTION ENGINE

[75] Inventors: Diethard Plohberger; Karl Wojik; Klaus Landfahrer, all of Graz, Austria

[73] Assignee: Avl Gesellschaft für verbrennungskraftmaschinen und Messtechnik m.b.H. Prof.Dr.Dr.h.c. Hans List, Graz, Austria

[21] Appl. No.: 440,194

[22] Filed: Nov. 22, 1989

[30] Foreign Application Priority Data

Nov. 24, 1988 [AT] Austria ..... 2892/88

[51] Int. Cl.[5] ..... F02B 75/32

[52] U.S. Cl. ..... 123/65 PD; 123/65 W

[58] Field of Search ..... 123/65 P, 65 PE, 73 PP, 123/65 PD, 65 W, 73 V

[56] References Cited

U.S. PATENT DOCUMENTS

| | | | |
|---|---|---|---|
| 1,176,096 | 3/1916 | Richter et al. | 123/65 PD |
| 2,016,344 | 10/1935 | Simmen | 123/65 PD |
| 2,137,344 | 11/1938 | McCarthy | 123/65 PD |
| 2,244,453 | 6/1941 | Fottinger et al. | 123/65 PD |
| 2,406,404 | 8/1946 | Ryde | 123/65 PD |
| 2,756,731 | 7/1956 | Wille | 123/65 PD |
| 2,778,348 | 1/1957 | Percival | 123/65 PD |
| 4,373,474 | 2/1983 | Schindler et al. | 123/65 PD |

FOREIGN PATENT DOCUMENTS

| | | | |
|---|---|---|---|
| 731097 | 12/1942 | Fed. Rep. of Germany | 123/65 PD |
| 19784 | of 1913 | United Kingdom | 123/65 PD |

*Primary Examiner*—2

*Assistant Examiner*—David A. Okonsky

*Attorney, Agent, or Firm*—Watson, Cole, Grindle & Watson

[57] ABSTRACT

In known two-stroke internal combustion engines with piston-controlled intake passages for the fresh charge and one or more exhaust passages for the exhaust gases, the actual direction of flow will deviate from the theoretical flow direction defined by the passage walls because of the influence exerted by the piston edge. The scavenge flow is deflected in the direction of the exhaust passage and the cylinder head, which will cause increased losses of fresh charge. This will considerably lower scavenge efficiency, and thus lead to a marked deterioration of engine performance, fuel consumption and exhaust emission. In the invention these disadvantages are avoided by aligning the flow guide vanes such that they form an angle, preferably of 90°, thus acting as a flow director.

12 Claims, 9 Drawing Sheets

Fig. 1
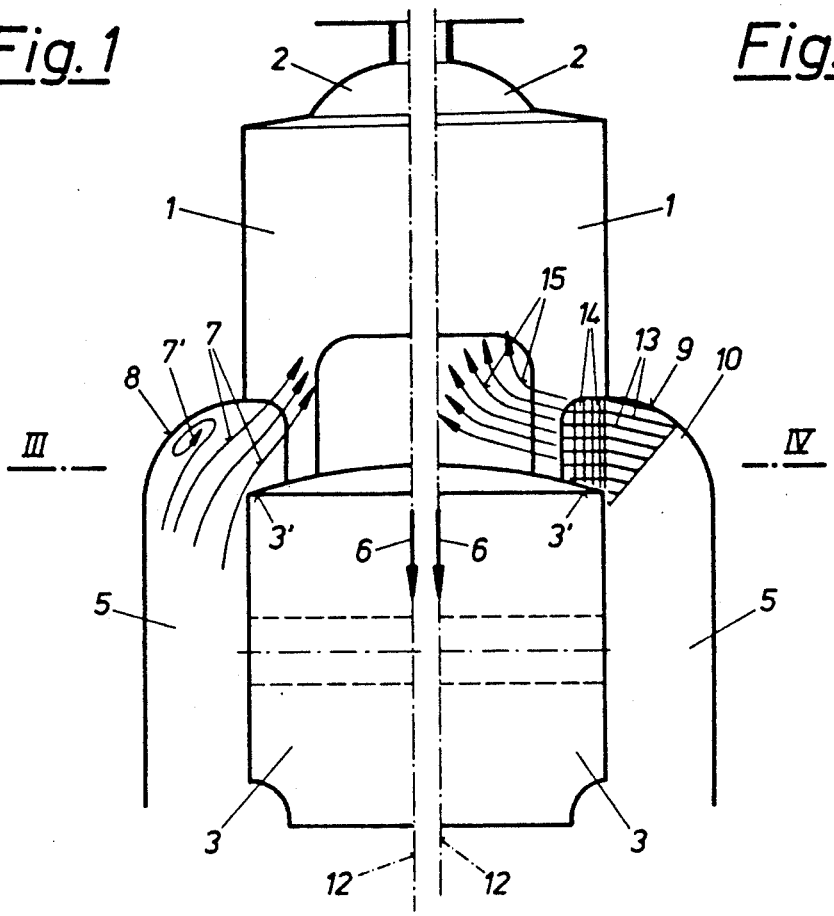
Fig. 2
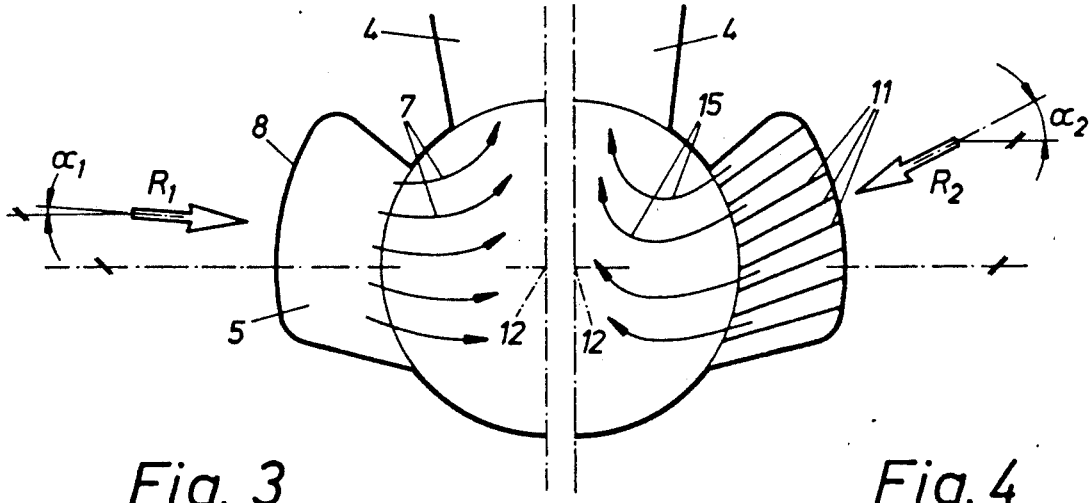
Fig. 3
Fig. 4

Fig. 5
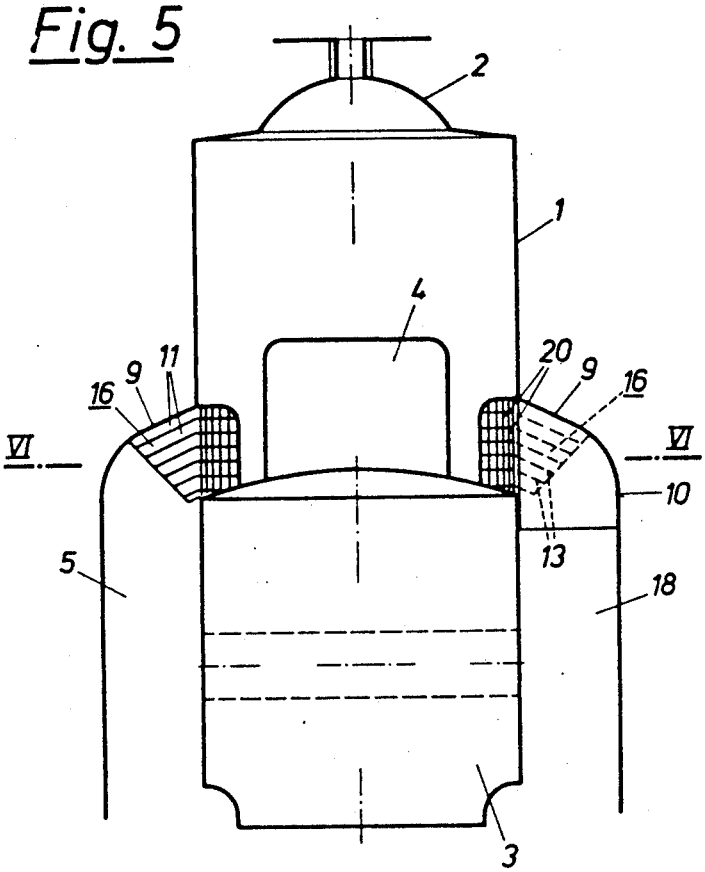
Fig. 7a
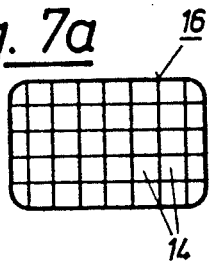
Fig. 7b
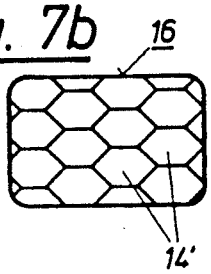
Fig. 7c
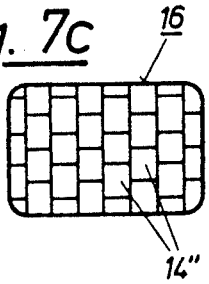
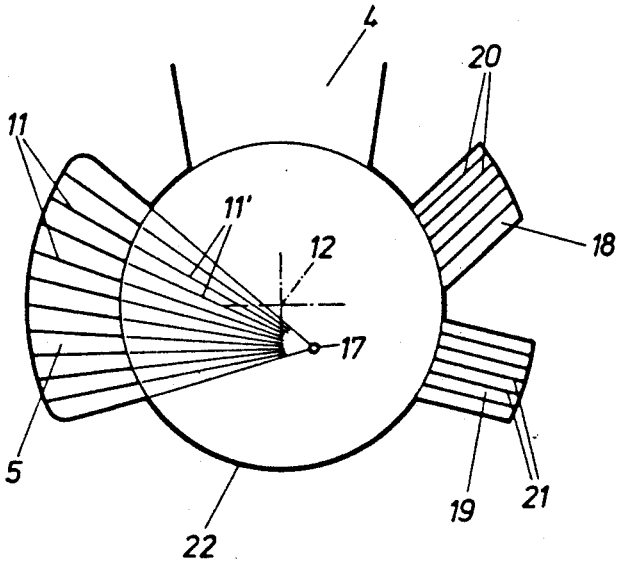
Fig. 6

TWO-STROKE INTERNAL COMBUSTION ENGINE

BACKGROUND OF THE INVENTION

This invention relates to a two-stroke internal combustion engine with piston-controlled intake passages for the fresh charge, which are provided with a number of flow guide vanes in the parts directly adjacent to the cylinder, and with one of more exhaust passages for the exhaust gases.

DESCRIPTION OF THE PRIOR ART

In conventional combustion engines of this kind with return-flow scavenging and piston-controlled intake and exhaust passages, the actual direction of flow deviates from the theoretical flow direction defined by the passage walls on account of the influence of the piston edge. The scavenge flow is deflected towards the exhaust passage and the cylinder head, which will increase the losses of fresh charge. This will considerably lower scavenge efficiency, and thus lead to a marked deterioration of engine performance, fuel consumption and exhaust emissions.

The use of guide vanes in the intake passage of a two-stroke engine with crankcase scavenging also is state of the art. Such vanes are used to improve the directive effect of the intake passage in order to prevent the entrance of fresh charge into the engine crankcase. For this purpose the intake passage is vertically subdivided by guide vanes. The intended effect is achieved only partly in this way, however.

SUMMARY OF THE INVENTION

It is an object of the invention to avoid such disadvantages and to prevent deviations of the scavenge flow from the pre-determined direction in both vertical and horizontal direction. This is achieved mainly by aligning the flow guide vanes such that they are at an angle, preferably of 90°, relative to each other, thus acting as a flow director. In this way the number of guide vanes for the scavenge flow is increased by a multiple over a design without flow directors, and the scavenging medium leaving the scavenge passage will essentially keep to the direction defined by the passage and the flow director. Although such flow directors will increase frictional losses of the scavenge flow, these losses are more than compensated by the considerable reduction of the losses of fresh charge, which will lead to a marked improvement of engine performance, fuel consumption and exhaust emissions.

In a further development of the invention the guide vanes may be plane and arranged in at least two parallel groups, the groups being positioned at such angles relative to each other that they form closed flow channels. In this way flow channels with cross-sections of various sizes and shapes may be produced in a simple manner, which will determine the behavior of the scavenge flow to a large extent.

A preferred version of the invention provides that the part of the intake manifold adjacent to the cylinder have a cylindrical shape and that the flow director be inserted into this part as one piece.

In another variant of the invention undesirable losses of fresh charge are reduced by arranging the guide vanes, which are positioned parallel to the cylinder axis, such that their extended traces converge centrically towards a point in the cylinder half opposite of the exhaust. In the context of this invention the flow passages formed to constitute the flow director may have a rectangular, preferably square, cross-section; they could also have hexagonal or honey-comb-type cross-sections, however.

It is recommended that the guide vanes have extremely thin walls, preferably made of sheet metal.

BRIEF DESCRIPTION OF THE DRAWINGS

Following is a more detailed description of the invention as illustrated by the accompanying drawings, in which FIG. 1 gives a schematical view of a conventional two-stroke internal combustion engine with return-flow scavenging, in an axial section, FIG. 2 gives a variant according to the invention in an axial section, FIGS. 3 and 4 each give a section along line III—IV in FIGS. 1 and 2, FIG. 5 gives another variant according to the invention in an axial section, FIG. 6 gives a section along line VI—VI in FIG. 5, and FIGS. *7a* to *7c* give a detail in three different variants Identical parts carry identical reference numbers.

DETAILED DESCRIPTION OF PREFERRED EMBODIMENTS

FIGS. 1 and 2 each show one half of a two-stroke internal combustion engine of a conventional design, the cylinder being marked 1, the cylinder head 2, and the piston 3. The piston 3 controls the exhaust passage 4 and the two intake passages 5 located on the two sides of the exhaust passage 4. The scavenge flow prevailing during the downward stroke of the piston 3 (cf arrow 6) is indicated by the flow lines 7. Because of the piston edge 3' the flow is deflected from the theoretical flow direction defined by the passage walls 8, which will produce vortexes 7'. As a consequence frictional losses and losses of fresh charge will increase.

In the invention guide vanes 11 are placed in the area 9 of the manifold 10 of the intake passages 5, which run parallel to the cylinder axis 12. Other guide vanes 13 are provided, which are running transversely to the cylinder axis and which will form flow channels 14 together with the guide vanes 11, thus causing the flow indicated by arrows 15 to remain unaffected by the piston edge 3'. With this configuration the negative effects with regard to engine performance, losses of fresh charge and exhaust emissions will be eliminated.

In FIGS. 3 and 4 the larger angle of incidence $a_2$ of the resulting flow $R_2$ made possible by the flow director is compared to the angle of incidence $a_1$ of the resulting flow $R_1$ in conventional designs.

In FIGS. 5 and 6 two variants of the invention are presented, both of which are characterized by the cylindrical shape areas 9 of the manifolds 10 of the intake passages 5, which will simplify manufacture and mounting of the flow director 16. In the variant shown in the left the extended traces 11' of the guide vanes 11 converge in point 17, which is situated in the lower half of the cylinder 1 in FIG. 6, i.e. on the side facing away from the exhaust passage 4. In this manner the losses of fresh charge may be further reduced.

In the variant shown on the right-hand side of FIGS. 5 and 6 two intake passages 18 and 19 are provided on each side of the exhaust passage 4, which again are provided with guide vanes 11, 13 and 20, 21, respectively, in the area 9 of the manifold 10. The intake passages 18 are directed towards the cylinder wall 22 opposite of the exhaust passage 4, whereas the intake passages 19 are directed towards the axis 12 of the cylinder.

FIGS. *7a* to *7c* present possible variants of the flow director as it appears in the area of the manifold 10 at the cylinder 1. Variant (a) has flow passages 14 of a square cross-section, variant (b) is characterized by its flow passages 14' being arraged in a honeycomb pattern, their cross-section being hexagonal. Variant (c) has flow passages 14'' of a rectangular cross-section, which are vertically staggered each by half the length of its cross-section. The configuration which is suited best for a particular application is usually found by experiment.

We claim:

1. A two-stroke internal combustion engine with piston-controlled intake passages and at least one exhaust passage, wherein each of said intake passages is provided with at least a first and a second group of flow guide vanes situated in a part of said intake passage directly adjacent to a cylinder of said internal combustion engine, wherein said guide vanes of said first group are postioned at an angle with respect to said guide vanes of said group, thereby forming laterally closed flow channels, and acting as a flow director.

2. A two-stroke internal combustion engine according to claim 1, wherein said guide vanes of said first group are positioned at an angle of 90 degrees with respect to said guide vanes of said second group.

3. A two-stroke internal combustion engine according to claim 1, wherein said guide vanes are plane and wherein all guide vanes of one of said groups are aligned parallel to each other.

4. A two-stroke internal combustion engine according to claim 1, wherein said part of said intake passage adjacent to said cylinder is cylindrically shaped, and wherein said flow director is insertable into said part as one piece.

5. A two stroke internal combustion engine according to claim 1, wherein said guide vanes of said first group are positioned parallel to the axis of said cylinder, and wherein said guide vanes lie in planes which converge centrically towards a point in the cylinder half opposite of said exhaust passage.

6. A two-stroke internal combustion engine according to claim 3, wherein said flow channels forming said flow director have a rectangular cross-section.

7. A two-stroke internal combustion engine according to claim 5, wherein said flow channels forming said flow director have a rectangular cross-section.

8. A two-stroke internal combustion engine according to claim 1, wherein said flow director is formed of flow channels of a hexagonal cross-section in honeycomb fashion.

9. A two-stroke internal combustion engine according to claim 5, wherein said flow director is formed of flow channels of a hexagonal cross-section in honeycomb fashion.

10. A two-stroke internal combustion engine according to claim 1, wherein siad guide vanes are made of thin sheet metal.

11. A two-stroke internal combustion engine according to claim 3, wherein said flow channels forming said flow director have a square cross-section.

12. A two-stroke internal combustion engine according to claim 5, wherein said flow channels forming said flow director have a square cross-section.

* * * * *